United States Patent [19]

Gruber et al.

[11] Patent Number: 4,556,624

[45] Date of Patent: Dec. 3, 1985

[54] TONER COMPOSITIONS WITH CROSSLINKED RESINS AND LOW MOLECULAR WEIGHT WAX COMPONENTS

[75] Inventors: Robert J. Gruber, Pittsford; Ronald J. Koch, Webster; John F. Knapp, Fairport; Steven B. Bolte, Rochester, all of N.Y.

[73] Assignee: Xerox Corporation, Stamford, Conn.

[21] Appl. No.: 655,381

[22] Filed: Sep. 27, 1984

[51] Int. Cl.[4] ..... G03G 9/00

[52] U.S. Cl. ..... 430/110; 430/107; 430/109

[58] Field of Search ..... 430/107, 109, 110

[56] References Cited

U.S. PATENT DOCUMENTS

| | | | |
|---|---|---|---|
| 3,079,342 | 2/1963 | Insalaco . | |
| 4,148,741 | 4/1979 | Bayley . | |
| 4,329,415 | 5/1982 | Ikeda et al. | 430/109 |
| 4,362,803 | 7/1982 | Miyakawa et al. | 430/122 |
| 4,385,107 | 5/1983 | Tanaka et al. | 430/98 |
| 4,481,274 | 11/1984 | Mitsuhashi et al. | 430/109 |

FOREIGN PATENT DOCUMENTS

| | | | |
|---|---|---|---|
| 0059109 | 9/1982 | European Pat. Off. | 430/110 |
| 55-156958 | 12/1980 | Japan | 430/109 |
| 57-82847 | 5/1982 | Japan | 430/107 |

*Primary Examiner*—Roland E. Martin

*Attorney, Agent, or Firm*—E. O. Palazzo

[57] ABSTRACT

Disclosed are improved positively charged electrostatic toner compositions comprised of a polyblend mixture of a crosslinked copolymer composition, and a second polymer, pigment particles, a wax component of a molecular weight of from 500 to about 20,000, and a charge enhancing additive. These compositions are particularly useful in imaging systems wherein release oils, such as silicone, are not required.

30 Claims, No Drawings

TONER COMPOSITIONS WITH CROSSLINKED RESINS AND LOW MOLECULAR WEIGHT WAX COMPONENTS

BACKGROUND

This invention is generally directed to toner and developer compositions. More specifically, the present invention is directed to toner compositions containing therein a low molecular weight wax, such as polyethylene, or polypropylene, and crosslinked copolymer resinous particles. Therefore, in accordance with one embodiment of the present invention there are provided toner and developer compositions having incorporated therein a low molecular weight wax, including polyethylene, and polypropylene, and a polyblend mixture of a crosslinked copolymer composition, and a second polymeric composition. Also, the toner compositions of the present invention can contain therein charge enhancing additives for the purpose of imparting positive charges to the toner resin particles enabling the use of these compositions in imaging systems wherein the photoreceptor imaging member is negatively charged. The toner and developer compositions of the present invention are useful in affecting the development of images in electrostatographic imaging systems wherein an offset preventing liquid, such as a silicone oil is not required.

Toner and developer compositions with waxy materials are known. Thus, for example, there is described in British Pat. No. 1,442,835 a toner composition comprised of a styrene homopolymer or copolymer resin, and at least one polyalkylene compound selected from polyethylene and polypropylene. According to the disclosure of this patent, reference page 2, beginning at line 90, the starting polymer resin may be either a homopolymer of styrene, or a copolymer of styrene with other unsaturated monomers, specific examples of which are disclosed on page 3, beginning at line 1. Polyalkylene compounds selected for incorporation into the toner compositions disclosed in this patent include those of a low molecular weight, such as polyethylene, and polypropylenes of an average molecular weight of from about 2,000 to about 6,000.

Additionally, there is disclosed in a copending application U.S. Ser. No. 434,198, now U.S. Pat. No. 4,460,672, entitled "Positively Charged Toner Compositions", a developer composition mixture comprised of electrostatic toner particles consisting of resin particles, pigment particles, a low molecular weight waxy material with a molecular weight of from about 500 to about 20,000, and further included in the composition from about 0.5 percent by weight to about 10 percent by weight of a charge enhancing additive selected from, for example, alkyl pyridinium halides, organic sulfonate compositions, and organic sulfate compositions. The disclosure of this copending application is totally incorporated herein by reference.

Also, there is disclosed in U.S. Pat. No. 4,206,247, a developer composition comprised of a mixture of resins including a low molecular weight polyolefin and alkyl modified phenol resins. More specifically, it is indicated in this patent, reference column 4, line 6, that the invention is directed to a process which comprises the steps of developing an image with toner particles containing in certain proportions at least one resin selected from group A, and at least one resin selected from group B, wherein the resins of group A include a low molecular weight polyethylene, a low molecular weight polypropylene, and similar materials, and wherein the group B resins include natural resin modified maleic acid resins, and natural modified pentaerythritol resins. As examples of group A resins there is mentioned polystyrene, styrene series copolymers, polyesters, epoxy resins, and the like, reference the disclosure in column 5, line 47. The molecular weight of the polypropylene, or polyethylene used is from about 1,000 to about 10,000, and preferably from about 1,000 to about 5,000.

Moreover, developer compositions with charge enhancing additives, especially additives which impart a positive charge to the toner resin are well-known. Thus, for example, there is described in U.S. Pat. No. 2,986,521, reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica. Additionally, in U.S. Pat. No. 3,893,935 there is described the utilization of certain quaternary ammonium salts as charge control agents for electrostatic toner compositions. In accordance with the disclosure of this patent, certain quaternary ammonium salts, when incorporated into a toner material, were found to provide a particular toner composition which exhibited relatively high uniform stable net toner charge when mixed with a suitable carrier vehicle, which toner also exhibited a minimum amount of toner throw off. There is also described in U.S. Pat. No. 4,298,672 positively charged toner compositions comprised of resin particles, and pigment particles, and as a charge enhancing additive alkyl pyridinium compounds and their hydrates of the formula as detailed in column 3, beginning at line 14. Examples of alkyl pyridinium compounds disclosed include cetyl pyridinium chloride. Also, there is disclosed in U.S. Pat. No. 4,338,390 positively charged developer compositions and organic sulfate, and sulfonate compositions as charge enhancing additives.

Developer compositions can be selected for use in developing electrostatic images, wherein the toner image is fixed to a permanent substrate such as paper by contacting the paper with a roller, the surface of which is formed from a material capable of preventing toner particles from sticking thereto. In this process, however, the surface of the fixing roll is brought into contact with the toner image in a hot melt state, thus a part of the toner image can adhere to and remain on the surface of the roll. This causes a part of the toner image to be transferred to the surface of a subsequent sheet on which the toner image is to be successively fixed, thereby causing the well-known undesirable offset phenomena.

In order to substantially eliminate offsetting, and more specifically for the purpose of preventing adhesion of the toner particles to the surface of the fixing roller, there has been selected certain types of rollers, the surface of which may be covered with a thin film of an offset preventing liquid such as a silicone oil. These oils are highly effective, however, the apparatus within which they are incorporated is complicated and costly since, for example, a means for feeding the oil is required. Also, not only do the silicone oils emit an undesirable odor, but these oils deposit on the machine components causing toner particles to collect on, and adhere to the silicone oils, which is highly undesirable. An accumulation of toner particles on machine components is troublesome in that image quality is adversely affected, and these components must be periodically cleaned and/or replaced, adding to the maintenance costs of the machine system involved.

Accordingly, there is a need for toner and developer compositions, especially those compositions with crosslinked resins which are useful in electrostatographic imaging systems. Additionally, there continues to be a need for improved toner and developer compositions which can be selected for the development and fixing of electrostatic latent images in electrostatographic imaging devices wherein offset preventing liquids, such as silicone oils, are not required. Furthermore, there is a need for toner and developer compositions comprised of a polyblend mixture of crosslinked copolymers and a second polymer. Moreover, there remains a need for toner and developer having incorporated therein low molecular weight waxes functioning as a release material. Furthermore, there remains a need for positively charged toner compositions comprised of a polyblend mixture of resin particles and low molecular weight waxes functioning as release components.

SUMMARY OF THE INVENTION

It is an object of the present invention to provide toner and developer compositions which overcome some of the above-noted disadvantages.

In another object of the present invention there is provided toner compositions with crosslinked copolymer resinous particles.

In another object of the present invention there is provided toner compositions comprised of a polyblend mixture of crosslinked copolymer resinous particles, and a second polymer.

In yet another object of the present invention, there are provided toner, and developer compositions containing therein low molecular weight polyethylene or polypropylene waxes.

In yet another object of the present invention, there are provided positively charged toner compositions of a polyblend mixture and charge enhancing additives.

In yet another object of the present invention, there are provided toner, and developer compositions which can be used in electrostatic imaging systems with no silicone oil release fluids.

It is an additional object of the present invention to provide methods for developing electrostatographic images with toner compositions comprised of a polyblend mixture of crosslinked polymers and a second resin, low molecular weight wax compositions, and wherein a silicone oil releasing fluid is not needed for preventing toner offset to the fuser rolls.

These and other objects of the present invention are accomplished by providing developer compositions, and toner compositions wherein the toner compositions are comprised of a polyblend mixture of a crosslinked copolymer composition with a second polymer, pigment particles, and a low molecular weight wax material. Also, as important components there can be included in the compositions of the present invention charge enhancing additives for the primary purpose of imparting positive charges to the toner resin particles.

In one embodiment of the present invention there are provided toner compositions comprised of a polyblend mixture of crosslinked copolymer resins, including styrene alkyl methacrylates crosslinked with, for example divinylbenzene, with a second polymer, including styrene butadiene copolymer resins, pigment particles, a low molecular weight wax composition, selected from the group consisting of polyethylene and polypropylene, and charge enhancing additives selected from the group consisting of alkyl pyridinium halides, reference U.S. Pat. No. 4,298,672, the disclosure of this patent being totally incorporated herein by reference, and organic sulfonate, and sulfate compositions. Specific illustrative examples of organic sulfonate and sulfate compositions include stearyl benzyl ammonium, paratoluene sulfonate, stearyl dimethyl phenethyl ammonium methyl sulfonate, stearyl dimethyl phenethyl ammonium para-toluene sulfonate, cetyl diethyl benzyl ammonium methyl sulfate, myristyl dimethyl phenethyl ammonium para-toluene sulfonate, cetyl diethyl benzyl ammonium methylsulfate, and the like, reference for example, U.S. Pat. No. 4,338,390, the disclosure of which is totally incorporated herein by reference. Other charge enhancing additives can be selected providing the objectives of the present invention are achieved, such as distearyl dimethyl ammonium methyl sulfate.

The charge enhancing additives are added in an effective amount enabling the toner resin particles to become positively charged. Generally these additives are mixed into the developer composition in an amount of from about 0.1 percent to about 20 percent by weight, and preferably in an amount of from about 1 percent by weight to about 5 percent by weight, based on the total weight of the toner particles. These additives can either be blended into the developer mixture or coated onto the pigment particles such as carbon black. The preferred charge enhancing additives incorporated into the toner compositions of the present invention include cetyl pyridinium chloride, cetyl pryidinium tetrafluoroborate, stearyl dimethyl phenethyl ammonium paratoluene sulfonate, and distearyl dimethyl ammonium methyl sulfate.

Illustrative examples of copolymer resins which are subsequently crosslinked, and thus useful for incorporation into the toner, and developer compositions of the present invention include, for example polyesters, styrene/butadiene resins, styrene/methacrylate resins, epoxies, vinyl resins and polymeric esterification products of a dicarboxylic acid and a diol comprising a diphenol. Suitable vinyl resins include homopolymers or copolymers of two or more vinyl monomers. Typical examples of vinyl monomeric units include: styrene, p-chlorostyrene, ethylenically unsaturated mono-olefins such as ethylene, propylene, butylene, isobutylene and other similar olefins; vinyl esters such as vinyl acetate, vinyl butyrate and the like; esters of alphamethylene aliphatic monocarboxylic acids such as methyl acrylate, ethyl acrylate, n-butylacrylate, isobutyl acrylate, methyl methacrylate, ethyl methacrylate, butyl methacrylate and the like; diolefins including styrene butadiene copolymers, and the like.

The preferred crosslinked toner resins are selected from polystyrene methacrylates, polyesters such as those described in U.S. Pat. No. 3,655,374, the disclosure of which is totally incorporated herein by reference, polyester resins resulting from the condensation of dimethylterephthalate, 1,3 butanediol, and pentaethylthriol, and Pliolite resins. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent. A specific styrene butadiene resin found highly useful in the present invention is comprised of about 89 percent of styrene, and 11 percent of butadiene.

The resins illustrated herein, as well as equivalent resin substances, are crosslinked with various known crosslinking compositions including aromatic and non-aromatic substances, such as divinylbenzene, ethylene glycol dimethylacrylate, and the like. It is important with respect to the present invention that the resins be crosslinked since it is in this manner that there is provided a reduction in undesirable offsetting of the toner image to the fuser rolls, extended fuser wearability, and improved release characteristics associated with the transfer of the developed toner image from the imaging member to a suitable substrate such as paper. Other crosslinking compounds can be used providing the objectives of the present invention are attained.

Crosslinking of the resin particles is effected by adding thereto in an amount of from 0.1 percent to about 10 percent by weight, the crosslinking composition, and reacting these materials at a temperature of from about 35° C. to about 150° C., until crosslinking is effected. By crosslinking, in accordance with the present invention, is meant to cause the resin polymer chains to be attached to the crosslinking materials selected by chemical bonding enabling the formation of a polymer network. The degree and extent of crosslinking is determined by known processes including glass transition temperature measurements, gel content, rheology, and the like.

With regard to the second polymer there can be selected various suitable thermoplastic polymers, including polyesters, styrene-butadiene copolymers, styrene-methacrylate copolymers, styrene-acrylate copolymers, polyamides, epoxies, vinyl resins and polymeric esterification products of a dicarboxylic acid and a diol comprising a diphenol. Suitable vinyl resins include homopolymers or copolymers of two or more vinyl monomers. Typical examples of vinyl monomeric units include: styrene, p-chlorostyrene, ethylenically unsaturated mono-olefins such as ethylene, propylene, butylene, isobutylene and the like; esters of alphamethylene aliphatic monocarboxylic acids such as methyl acrylate, ethyl acrylate, n-butylacrylate, isobutyl acrylate, dodecyl acrylate, n-octyl acrylate, methyl methacrylate, ethyl methacrylate, butyl methacrylate and the like; diolefins, including styrene butadiene copolymers, and the like.

With further reference to the polyblend mixture, generally the crosslinked copolymer is present therein in an amount of from about 5 percent by weight to about 80 percent by weight, while the second resin polymer is contained in the mixture in an amount of from about 95 percent by weight to about 20 percent by weight. In one preferred embodiment of the present invention, the crosslinked copolymer resin styrene-butylmethacrylate is present in an amount of from about 15 percent by weight to about 30 percent by weight, with a second polymer of styrene butadiene in an amount of from about 85 percent by weight to about 70 percent by weight. While it is not desired to be limited by theory, it is believed that the crosslinked polymer assists in the reinforcement of the second polymer component thereby enabling a significant reduction in toner offsetting of the developed image to the fuser rolls, for example.

The low molecular weight waxy component incorporated into the toner composition generally has a molecular weight of from about 500 to about 20,000, and preferably of from about 1,000 to about 5,000. Illustrative examples of waxy materials included within the scope of the present invention are polyethylenes commercially available from Allied Chemical and Petrolite Corporation; Epolene N-15, commercially available from Eastman Chemical Products Company; Viscol 550-P, a low molecular weight polypropylene available from Sanyo Kasei K.K.; and similar materials. The commercially available polyethylenes selected have a molecular weight of about 1,000 to 1,500 while the commercially available polypropylenes incorporated into the toner compositions of the present invention have a molecular weight of from about 4,000 to about 6,000. Many of the polyethylene and polypropylene compositions useful in the present invention are illustrated in British Pat. No. 1,442,835.

The low molecular weight wax materials can be incorporated into the toner compositions in various amounts, however, generally these waxes are present in an amount of from about 1 percent by weight to about 30 percent by weight, and preferably in an amount of from about 2 percent by weight to about 10 percent by weight.

Various suitable colorants and/or pigment particles may be incorporated into the toner and developer composition of the present invention including, for example, carbon black, Nigrosine dye, magnetic particles, such as Mapico Black, a mixture of iron oxides, and the like. The pigment particles are present in the toner in sufficient quantities so as to render it highly colored enabling the formation of a visible image on a recording member. Thus, for example, the pigment particles, with the exception of magnetic materials, should be present in the toner composition in an amount of from about 2 percent by weight to about 15 percent by weight, and preferably from about 2 percent by weight to about 10 percent by weight. With regard to magnetic pigments such as Mapico Black, they are generally incorporated into the toner composition in an amount of from about 10 percent by weight to about 70 percent by weight, and preferably in an amount of from about 20 percent by weight to about 50 percent by weight.

While the magnetic particles can be present in the toner composition as the only pigment, these particles may be combined with other pigments such as carbon black. Thus, for example, in this embodiment of the present invention, the other pigments are present in an amount of from about 10 percent by weight to about 15 percent by weight, mixed with from about 10 to about 60 percent by weight of magnetic pigment. Other percentage combinations may be selected provided the objectives of the present invention are achieved.

The toner resin particles are generally present in the toner composition in an amount to provide a composition which will result in a total of about 100 percent for all components. Accordingly, for non-magnetic toner compositions the toner resin is generally present in an amount of from about 60 percent by weight to about 90 percent by weight, and preferably in an amount from about 80 percent by weight to about 85 percent by weight. In one prefered embodiment the toner composition is comprised of about 65 percent by weight of a styrene butadiene copolymer, 89 percent styrene, and 11 percent butadiene; about 25 percent by weight of a crosslinked styrene-n-butylmethacrylate, 58 percent by weight of styrene, 42 percent by weight of n-butylmethacrylate, and 0.2 percent by weight of divinylbenzene; 5 percent by weight of polypropylene 550-P wax; and 6 percent by weight of carbon black particles.

Many known methods may be used for preparing the toner compositions of the present invention, inclusive of extrusion processing and melt blending the resin particles, the pigment particles, the charge enhancing additive, and the low molecular weight wax, followed by mechanical attrition.

Illustrative examples of various carrier materials selected for incorporation into the developer composition include those substances that are capable of triboelectrically obtaining a charge of opposite polarity to that of the toner particles including, for example, steel, iron ferrites, and the like. These carriers can be used with or without a coating, which coatings are comprised of fluoropolymers, including polyvinylidene fluoride commercially available from E. I. duPont Company. Additionally, there can be selected nodular carrier beads of nickel characterized by surfaces of reoccurring recesses and protrusions, as described in U.S. Pat. Nos. 3,847,604 and 3,767,598, thus providing particles with a relatively large external area. The diameter of the coated carrier particles is from about 50 microns to about 1,000 microns, thus allowing the carrier particles to possess sufficient density and inertia to avoid adherence to the electrostatic images during the development process.

The carrier particles are mixed with the toner composition in various suitable combinations, however, best results are obtained with from about 1 part by weight of toner particles to about 100 parts to 1,000 parts by weight of carrier particles. Preferred are developer compositions wherein the toner concentration varies from about 1 percent to about 5 percent.

The toner and developer compositions of the present invention are useful for developing electrostatic latent images, particularly those generated on a negatively charged imaging member. When using the developing compositions of the present invention, it is not necessary to utilize a release fluid, such as a silicone oil to prevent toner offset, since the compositions of the present invention prevent toner offset without a toner release fluid. Additionally, as indicated hereinbefore, the toner compositions of the present invention can be charged positively, in view of the presence of the charge enhancing additive.

Examples of imaging members that may be selected include various known photoreceptors, particularly those which are negatively charged, which usually occurs with organic devices including layered photoreceptor members. Illustrative examples of layered photoresponsive materials include those with a substrate, a generating layer, and a transport layer, as disclosed in U.S. Pat. No. 4,265,990, the disclosure of which is totally incorporated herein by reference. Examples of generating layers are trigonal selenium, metal phthalocyanines, metal free phthalocyanines, and vanadyl phthalocyanine, while examples of transport materials include various aryl amines dispersed in resinous binders. Other organic photoresponsive materials that may be utilized in the practice of the present invention include polyvinyl carbazole, 4-dimethylaminobenzylidene, benzhydrazide; 2-benzylidene-amino-carbazole, (2-nitrobenzylidene)-p-bromoaniline; 2,4-diphenylquinazoline; 1,2,4-triazine; 1,5-diphenyl-3-methyl pyrazoline 2-(4'-dimethyl-amino phenyl)-benzoxazole; 3-amino-carbazole; polyvinylcarbazole-trinitrofluorenone charge transfer complex; and mixtures thereof.

The imaging method of the present invention comprises the formation of a negatively charged electrostatic latent image on a suitable imaging member, contacting the image with the developer composition of the present invention comprised of toner particles and carrier particles, transferring the developed image to a suitable substrate such as paper, and permanently affixing the image thereto by various suitable means such as heat.

The following examples are being supplied to further define specific embodiments of the present invention, it being noted that these examples are intended to illustrate and not limit the scope of the present invention. Parts and percentages are by weight unless otherwise indicated.

EXAMPLE I

There was prepared by melt blending in a Banbury mixing device, maintained at 120° C., followed by mechanical attrition, a toner composition containing 62 percent by weight of a copolymer resin of styrene-n-butylmethacrylate, containing 58 percent by weight of styrene, and 42 percent by weight of n-butylmethacrylate, 25 percent by weight of a styrene-n-butylmethacrylate copolymer, (58/42) crosslinked with 0.2 percent by weight of divinylbenzene, 6 percent by weight of carbon black, Regal 330, 2 percent by weight of cetyl pyridinium chloride, and 5 percent by weight of polypropylene of a molecular weight of about 5,000, commercially available as Viscol 550-P from Sanyo Corporation.

A developer composition was then prepared by mixing 2 parts by weight of the above prepared toner composition with 100 parts by weight of carrier particles consisting of a steel core coated with 1.25 percent by weight of copolymer of chlorotrifluoroethylene and vinyl chloride.

The triboelectric charge for the above-prepared toner particles was a positive 1 femtocoulomb per micron as determined on a toner charge spectrograph. This known instrument disperses toner particles in proportion to the charge to diameter ratio, and with the aid of automated microscopy can generate charge distribution histograms for selected toner size classes.

The following toner compositions were then prepared by repeating the procedure of Example I, with the following results:

TABLE I

| TONER POLYMER RESIN | CHARGE ENHANCING ADDITIVE | LOW MOLECULAR WEIGHT WAX | MINIMUM FIX TEMP MFT (1) FUSING TEMP °F. | FUSING (2) LATITUDE °F. | RELEASE (3) CHARACTERISTIC |
|---|---|---|---|---|---|
| 1. Styrene-n-butylmethacrylate (58/42) 84.7%, 10.3% | cetyl pyridinium chloride, | 5% by weight polypropylene | 320 | 10 | very poor |

TABLE I-continued

| TONER POLYMER RESIN | CHARGE ENHANCING ADDITIVE | LOW MOLECULAR WEIGHT WAX | MINIMUM FIX TEMP MFT (1) FUSING TEMP °F. | FUSING (2) LATITUDE °F. | RELEASE (3) CHARACTERISTIC |
|---|---|---|---|---|---|
| carbon black | 2% by weight | 550-P | | | |
| 2. Styrene-n-butylmethacrylate (58/42) 62%, and 25% of a crosslinked styrene-n-butylmethacrylate copolymer resin (58/42), 6.0% carbon black | cetyl pyridinium chloride, 2% by weight | 5% by weight polypropylene 550-P | 325 | 90 | excellent |
| 3. 62% Styrene-n-butylmethacrylate (58/42) 25% of a crosslinked styrene-n-butylmethacrylate (58/42), and 6% carbon black | cetyl pyridinium chloride, 2% by weight | Barceo wax 1000, 5% by weight | 325 | 100 | excellent |
| 4. Polyester (4) 86% by weight, 10% by weight carbon black | cetyl pyridinium chloride, 2% by weight | Polypropylene 550-P 2% by weight | 305 | 50 | poor |
| 5. Polyester (4) 86% by weight 10% by weight carbon black | cetyl pyridinium chloride, 2% by weight | Barceo wax 1,000, 2% by weight | 310 | 50 | poor |
| 6. Polyester (4) 61% by weight, 25% of crosslinked styrene-n-butylmethacrylate (58/42) and 10% by weight of carbon black | cetyl pyridinium chloride, 2% by weight | Barceo wax 1,000, 2% by weight | 310 | 105 | excellent |
| 7. Polyester (4) 61% by weight 25% of crosslinked polyester (4) and 10% carbon black | cetyl pyridinium chloride, 2% by weight | Polypropylene 550-P 5% by weight | 300 | 110 | excellent |
| 8. Pliolite (5) 87% by weight, 6% by weight carbon black | cetyl pyridinium chloride, 2% by weight | Polypropylene 550-P 5% by weight | 300 | 45 | poor |
| 9. 62% Pliolite (5) by weight, 25% of crosslinked styrene-n-butylmethacrylate (58/42) and 6% by weight carbon black | cetyl pyridinium chloride, 2% by weight | Polypropylene 550-P 5% by weight | 310 | 120 | excellent |
| 10. 62% Pliolite (5) by weight, 25% of crosslinked styrene-n-butylmethacrylate (58/42) and 6% by weight carbon black | cetyl pyridinium chloride, 2% by weight | Barceo wax 1,000 5% by weight | 310 | 110 | excellent |
| 11. 65% Pliolite (5) by weight, 25% of crosslinked styrene-butadiene and 10% by weight of carbon black | cetyl pyridinium chloride, 2% by weight | Polypropylene 550-P 2% by weight | 300 | 105 | very good |

(1) The designation MFT represents the minimum temperature required to produce an acceptable toner fix to paper.
(2) The difference between the MFT, the minimum fix temperature, and the temperature at which toner begins to stick to the fuser roll is the fusing latitude. An acceptable fusing latitude would be about 50° F.
The fusing experiments were performed in the Xerox 9200 copier fuser assembly. The fuser assembly did not contain silicone oil.
(3) By very poor release characterisitics is meant that the toner accumulates slowly on the fuser roll, eventually begins to offset, and transfer to the fuser roll. This toner will eventually deposit on paper with the electrostatic latent image thereon. Additionally, in some instances, toner deposits on the fuser roll will cause paper to stick to the roll. In contrast, excellent release characteristics result in substantially no toner being deposited on the fuser roll of the 9200 fuser assembly. Additionally, excellent release characterisitcs are characterized by toners having a fusing latitude of greater than 50° F. with very little, if any toner accumulation occurring on the 9200 fuser assembly after extended copy throughput, over 35,000 copy cycles.
(4) The polyester specified resulted from the condensation reaction of dimethylterephthalate, 1,3 butanediol, and pentaerythritol.
(5) The Pliolite styrene butadiene resins were obtained from Goodyear.

Developer compositions were then prepared by mixing 1 part by weight of the toner compositions designated 2, 3, 6, 7, 10 and 11 in Table I, which toner compositions were comprised of the polymer blend, carbon black, charge enhancing additive and low molecular weight wax in the proportions listed, with 100 parts by weight of a carrier material consisting of a ferrite core coated with 0.8 percent by weight of a polychlorotrifluoroethylene-covinylchloride copolymer commercially available from Hooker Chemical Corporation as FPC 461.

Each of these developer compositions were then utilized in a xerographic imaging test system wherein the photoreceptor is comprised of a trigonal selenium generating layer in contact with an amine transport layer of N,N'-diphenyl-N'-bis(3-methylphenyl)-[1,1'-biphenyl]-4,4' diamine dispersed in a polycarbonate resinous binder. This photoreceptor was prepared as disclosed in U.S. Pat. No. 4,265,990, and was charged negatively. There is immediately obtained after one imaging cycle, images of high quality and excellent resolution. Although the xerographic imaging system contained no silicone fuser release oil, excellent fusing of the toner particles was observed since no smearing or smudging of the images resulted, and no offsetting was observed after 10,000 imaging cycles with each of the developer compositions.

Other modifications of the present invention will occur to those skilled in the art based upon a reading of the present disclosure. These are intended to be included within the scope of this invention.

We claim:

1. An improved positively charged electrostatic toner composition consisting essentially of a polyblend mixture with from about 5 percent by weight to about 80 percent by weight of a crosslinked copolymer composition, and from about 20 percent by weight to about 95 percent by weight of a second thermoplastic polymer, pigment particles, a wax component of a molecular weight of from 500 to about 20,000, and a charge enhancing additive.

2. A toner composition in accordance with claim 1, wherein the crosslinked copolymer is a styrene alkyl methacrylate, or a styrene butadiene polymer.

3. A toner composition in accordance with claim 2, wherein the styrene alkyl methacrylate is styrene-n-butylmethacrylate.

4. A toner composition in accordance with claim 2, wherein the crosslinking agent is divinylbenzene.

5. A toner composition in accordance with claim 1, wherein the second polymer is selected from the group consisting of styrene polymers, and polyesters.

6. A toner composition in accordance with claim 2, wherein the styrene polymer is a styrene-n-butylmethacrylate copolymer crosslinked with divinylbenzene, and the second polymer is a styrene butadiene copolymer.

7. A toner composition in accordance with claim 1, wherein the pigment particles are carbon black.

8. A toner composition in accordance with claim 1, wherein the wax component is selected from the group consisting of polyethylene and polypropylene.

9. A toner composition in accordance with claim 8, wherein the polyethylene or polypropylene is present in an amount of from about 1 percent by weight to about 10 percent by weight.

10. A toner composition in accordance with claim 1, wherein the charge enhancing additive is present in an amount of from about 0.1 percent by weight to about 10 percent by weight.

11. A toner composition in accordance with claim 10, wherein the charge enhancing additive is stearyl dimethyl phenethyl ammonium paratoluene sulfonate, or cetyl pyridinium chloride.

12. A developer composition comprised of the toner composition of claim 1 and carrier particles.

13. A developer composition in accordance with claim 12, wherein the carrier particles consist of a steel core coated with a polychlorotrifluoroethylene-co-vinylchloride copolymer.

14. A developer composition in accordance with claim 12, wherein the crosslinked copolymer is styrene-n-butylmethacrylate.

15. A developer composition in accordance with claim 12, wherein the polyblend mixture is comprised of a crosslinked copolymer of styrene-n-butylmethacrylate, and the second polymer is a styrene butadiene copolymer.

16. A developer composition in accordance with claim 12, wherein the waxy material is selected from the group consisting of polyethylene and polypropylene.

17. A method for developing latent images which comprises forming an electrostatic latent image on a photoconductive imaging member, contacting the image with the toner composition of claim 1, followed by transferring the image to a suitable substrate, and optionally permanently affixing the image thereto.

18. A method of imaging in accordance with claim 17, wherein the crosslinked copolymer is a styrene methacrylate copolymer.

19. A method of imaging in accordance with claim 17, wherein the resin particles are comprised of a polyblend mixture of a crosslinked copolymer of styrene-n-butylmethacrylate, and a second polymer is a styrene butadiene copolymer.

20. A method of imaging in accordance with claim 17, wherein the process is accomplished in the absence of a silicone oil release fluid, and there results no offsetting of the resulting images.

21. A toner composition in accordance with claim 1 wherein the crosslinked polymer is present in an amount of from about 15 percent by weight to about 30 percent by weight, and the second polymer is present in an amount of from about 70 percent by weight to about 85 percent by weight.

22. A positively charged toner composition with improved offset characteristics consisting essentially of a polyblend mixture with from about 5 percent by weight to about 80 percent by weight of a crosslinked copolymer composition; from about 20 percent by weight to about 95 percent by weight of a second thermoplastic polymer; pigment particles; a wax component with a molecular weight of from about 500 to about 5,000; and a charge enhancing additive.

23. A toner composition in accordance with claim 22 wherein the crosslinked polymer is a styrene alkyl methacrylate, or styrene butadiene; and wherein the second polymer is selected from the group consisting of styrene polymers and polyesters.

24. A toner composition in accordance with claim 22 wherein the wax component is selected from the group consisting of polyethylene and polypropylene; and the charge enhancing additive is stearyl dimethyl phenethyl ammonium para-toluene sulfonate, or cetyl pyridinium chloride.

25. A toner composition in accordance with claim 22 wherein there is present about 25 percent by weight of a crosslinked styrene n-butyl methacrylate copolymer, and about 65 percent by weight of a styrene n-butyl methacrylate copolymer.

26. A toner composition in accordance with claim 22 wherein there is present about 25 percent by weight of a crosslinked styrene-n-butyl methacrylate, and about 60 percent by weight of a polyester.

27. A toner composition in accordance with claim 22 wherein there is present about 25 percent by weight of a crosslinked styrene-n-butyl methacrylate, and about 60 percent by weight of a styrene butadiene copolymer.

28. A developer composition comprised of the toner composition of claim 22 and carrier particles.

29. A developer composition in accordance with claim 12 wherein the carrier particles consist of a ferrite core with a coating thereover.

30. A developer composition in accordance with claim 29 wherein the coating is comprised of a copolymer of chlorotrifluoroethylene and vinyl chloride.

* * * * *